US005489316A

United States Patent [19]

Traverso

[11] Patent Number: 5,489,316

[45] Date of Patent: Feb. 6, 1996

[54] PROCESS FOR MAKING INDUSTRIAL ORGANIC SOLVENTS AND HYDROCARBONS USED AS FUELS

[75] Inventor: Enrico Traverso, Monza, Italy

[73] Assignee: Enichem Synthesis S.p.A., Palermo, Italy

[21] Appl. No.: 414,593

[22] Filed: Mar. 31, 1995

[30] Foreign Application Priority Data

Apr. 14, 1994 [IT] Italy ..... MI94A0703

[51] Int. Cl.[6] ..... C10L 1/22; C10L 3/00

[52] U.S. Cl. ..... 44/323

[58] Field of Search ..... 44/323

[56] References Cited

U.S. PATENT DOCUMENTS 2,645,079 7/1953 Doumani et al. ..... 44/323

3,002,827 10/1961 Fenske ..... 44/323

5,162,048 11/1992 Diaz-Valdes ..... 44/323

FOREIGN PATENT DOCUMENTS 3924596 11/1990 Germany .

2006598 1/1990 Japan .

*Primary Examiner*—Ellen M. McAvoy

*Attorney, Agent, or Firm*—Oblon, Spivak, McClelland, Maier & Neustadt

[57] ABSTRACT

Process for marking industrial organic solvents miscible with water and petroleum products gaseous at atmospheric pressure and room temperature and liquid when compressed at low pressure, by the addition to the above solvents of a primary nitroderivative having the general formula $R\text{-}CH_2\text{-}NO_2$

11 Claims, No Drawings

PROCESS FOR MAKING INDUSTRIAL ORGANIC SOLVENTS AND HYDROCARBONS USED AS FUELS

The present invention relates to a process for marking industrial organic solvents and petroleum products used as fuels.

More specifically, the present invention relates to a process for marking industrial organic solvents miscible with water, for example alcohols with a low molecular weight, and petroleum products which are gaseous at atmospheric pressure and liquid when compressed at low pressure, such as for example propane, butane, liquefied petroleum gas (GPL) and relative mixtures.

The necessity for marking industrial organic solvents or petroleum products, such as fuels and gasolines, derives from the difference in the sales price that the same product can have owing to the different taxation which can be applied depending on its destination.

This can lead to situations involving fiscal frauds by using the product for different purposes than those for which it is taxed.

To prevent frauds of this kind industrial organic solvents and petroleum products are marked with a suitable substance which permits it to be easily identified.

Substances which can be used as markers should have definite requisites, for example they should be stable under operating conditions and be of such a nature as to not influence the physico-chemical characteristics of the organic solvent or petroleum product, they should be sufficiently soluble and preferably to such a degree as to be able to be used also in the form of concentrated solutions, they should be difficult to separate with physical or physico-chemical methods (unless at uneconomical costs), and they should be able to be used in small quantities. In addition, the above marker substances should be identifiable with simple, rapid and sensitive detection methods.

For example GPL (mixture of aliphatic hydrocarbons consisting for more than 95% of propane gas) can be stored, compressed in a liquid phase at 5–10 $Kg/cm^2$, in cylinders of about 40 litres or in tanks of various cubic metres in volume. GPL is supplied, during use, in gas phase.

In Italy GPL for domestic (cooker, heating) and industrial use has tax facilitations compared to the GPL used for road motor vehicles.

To avoid similar frauds, a composition is added by law to the GPL for domestic use, consisting of: a) furan, in a quantity of from 10 to 50 p.p.m., detectable in gas phase by reaction with aniline and acetic acid on cotton-wool with the formation of a red colouring. This substance however has various disadvantages, for example, it is extremely toxic (T.L.V.=2 P.P.M.), it is difficult to detect owing to the small quantities used, it has a high boiling point (164° C.) which limits its presence in gas phase; b) the so-called marker A, a concentrated aromatic solution of the yellow azoic dye 1-[N-ethyl-N-(4',7'-dimethyl-3',5'-dioxa-octyl]-amino-4-phenylazo-benzene. This product is used in quantity of 5–20 p.p.m., and is detectable in the liquid phase of GPL by reaction on cotton-wool with an aqueous solution of hydrochloric acid with the formation of a purplish-red colour. This so-called marker A has numerous disadvantages however as it is not completely soluble and leaves pitchy deposits in the tanks and decanting lines, with consequent problems of cleaning and washing. In addition it is drawn in the gas phase during supply and this causes drawbacks due to pollution of the operating equipment, for example the formation of deposits on compressor membranes and in other critical parts and the plastication of seals.

A process has now been found for marking industrial organic solvents miscible with water and petroleum products, gaseous at atmospheric pressure and room temperature and liquid upon light compression, which overcomes the disadvantages described above.

In accordance with this the present invention relates to a process for marking industrial organic solvents miscible with water and petroleum products gaseous at atmospheric pressure and room temperature and liquid when compressed at low pressure, which consists in adding to the above solvents or petroleum products small quantities of a primary nitroderivative having general formula (I)

$$R\text{-}CH_2\text{-}NO_2 \qquad (I)$$

wherein R is selected from H, $CH_3$, $C_2H_5$.

Unlike the marking agents of the known art, the nitroderivates of general formula (I) can be easily identified and have the requisites specified above.

The nitroderivatives of general formula (I) can be advantageously used for marking industrial organic solvents miscible with water, for example methanol, ethanol, iso or n-propanol, glycols, polyols and glycolethers. In fact the nitroderivatives of general formula (I) have a good miscibility with water (for nitromethane this value is 10.5%, for nitroethane from 4.6% to 20%) and consequently they cannot be extracted in a heterogeneous aqueous phase as these solvents are also miscible in this.

The nitroderivatives of general formula (I) can also be used for marking gaseous hydrocarbons compressed in a liquid phase at low pressure (indicatively at a pressure lower than 10 bars), such as propane, butane and GPL. The possible extraction of the nitroderivative of general formula (I) from the above hydrocarbons in a heterogeneous aqueous phase would be a costly operation as it would require pressure-proof equipment and the final anhydrification of the hydrocarbon mixture.

The nitroderivatives of general formula (I) can be used as such or diluted with other inert components.

If the compound of general formula (I) is nitromethane, it is preferable for it to be diluted with desensitizing agents capable of considerably reducing its explosive characteristics.

Nitromethane in fact has the disadvantage of exploding in the following three critical conditions:

a) when it is subjected to violent mechanical shock, higher than that caused by a calibre 8 bullet;

b) when it is subjected to rapid and violent adiabatic compression;

c) when is it heated, in a closed container, to a temperature close to critical temperature (315° C.).

In mixtures based on nitromethane, the desensitizing agents can be, for example, cyclohexane, 1,4-dioxane, 1,2-butylene-oxide, methanol, ethanol, isopropanol, 1- and 2-nitropropane, methyl chloroform, toluene, benzene, methylene chloride. The above desensitizing agents can be mixed with the nitromethane in a minimum recommended quantity of from 25 to 50%.

Compared to the products of the known art, the nitroderivatives of general formula (I) are not toxic, having a TLV of between 100 and 150 p.p.m. In addition they are colourless liquids, soluble in hydrocarbons in a quantity higher than 2%.

They can be used as the sole marking product, as they can be detectable both in the gas and liquid phase of GPL, the boiling point of nitromethane being 101° C., and that of nitroethane 114° C.

The nitroderivatives of general formula (I) can be used in GPL and in industrial organic solvents in a quantity of between 10 and 200 p.p.m., preferably between 20 and 100 p.p.m.

The above nitroderivatives of general formula (I) can be detected in the GPL directly on site by means of two different chromatic reactions (method A and method B) which give shades of colouring varying from blue to red depending on the operating procedure of the test.

With respect to method A, this is a reaction, valid for all primary nitroderivatives, which takes place in the presence of polar solvents in a basic environment between the nitroderivative and the diazonium salt of an aromatic amine, preferably o-dianisidene (FAST BLUE B SALT), a compound which is easily available on the market in powder form.

The above reaction is cited in literature (Feigl Spot tests in Organic Analysis—seventh Edition, page 296) which however indicates conditions which give colourings varying from yellow to orange. We, on the other hand, have created conditions which give darker shades, depending on the type of solvent and the quantity of base: from blue to red for nitromethane, from violet-red to orange for nitroethane.

As far as method B is concerned, this is only valid for nitromethane.

The reaction takes place in an aqueous medium, at basic pH (from 9 to 12), between the nitromethane and 1,2-naphthoquinone-4-sodium sulphonate.

A chromatic reaction occurs which gives a blue to violet colouring depending on the test conditions and above all the solvent mixture. The colouring has its maximum intensity and stability at a pH of between 9.4 and 9.8, but its development is more rapid at higher pHs; the maximum absorption is within the range of 565– 585 nm.

The reaction, very sensitive, is described in literature (Turba et al.—Angewandte Chemie 1949, Vol. 61/2, pages 74–75; Jones, Riddick—Analytical Chemistry, 1956, Vol. 28/9 page 1493 on). The second reference indicates the conditions for the spectrophotometric quantitative determination in the visible range of the nitromethane.

With respect to the operating procedure of the tests on site to verify the presence of the marker, in the case of GPL the procedure is as follows: a cotton flock, soaked in basic reaction solvent, is placed, for 10–20 seconds, against a stream of GPL removed either in the liquid or gas phase. The marker of general formula (I) is extracted and dissolved in the basic solvent, and then chromatically displayed by the addition, on the cotton flock, of several drops of aqueous reagent solution.

The following examples provide a better understanding of the present invention:

EXAMPLES

Method A is described in examples 1–6, i.e. the copulation reaction of primary aliphatic nitroderivatives with diazonium salt FAST BLUE B SALT (FBBS).

Method B is described in examples 7–9, i.e. the reaction of nitromethane with 1,2-naphthoquinone-4-sodium sulphonate (NQS).

EXAMPLE 1

100 grams of GPL marked with 50 p.p.m. of nitromethane are bubbled, in 60 minutes, into a Drechsel 250 ml glass bottle equipped with a porous septum, containing 100 grams of mixture consisting of 60 parts of N,N-dimethylformamide and 40 parts of a methanol solution of KOH at 2.5%.

The G.P.L. is directly removed from its compressed liquid phase (8 kg/cm$^2$) contained in a 40 litre cylinder filled for 90% of its volume (about 18 kg of GPL).

When the removal has been completed 20 grams of methanol solution at 0.1% of FAST BLUE B SALT (tetrazonium salt of 0-dianisidene), freshly prepared are added to the bottle.

A deep reddish-purple colouring develops determined by the copulation between the tetrazonium salt and nitromethane transferred to the extraction solution.

EXAMPLE 2

The test is similar to that described in example 1, with the difference that the GPL marked with 5 grams/100 kg of nitromethane is removed directly from the gas phase.

A red colouring develops, a little less intense than that in example 1.

EXAMPLE 3

The test is similar to that described in example 1, with the difference that the GPL, poured from its liquid phase, is marked with 5 grams/100 kg of nitroethane.

A deep red-orange colouring develops.

EXAMPLE 4

A solution is prepared consisting of 100 parts of N,N-dimethyl formamide with a low water content (<0.15%) and 0.3 parts of methanol, made basic by the addition of 2 parts of KOH in drops which mostly remains undissolved as a precipitate.

A cotton flock, soaked in this solution, is treated for 2–3 seconds with the liquid flow of GPL marked with 5 grams/100 kg of nitromethane and contained in the cylinder of example 1.

The cotton flock is then treated with several drops of 0.1% methanol solution of FAST BLUE B SALT.

A deep blue colouring develops immediately.

A similar colouring but a little weaker appears after the cotton flock, soaked in the same solution, has been subjected for 10–15 seconds to the flow of the gas phase of the same GPL marked, and then treated with the same reagent.

EXAMPLE 5

A solution consisting of 100 parts of anhydrous diethyleneglycol dimethylether (diglyme) and 0.5 parts of a solution at 13% of KOH is prepared.

Two cotton flocks soaked in this solution are treated respectively, as described in example 4, with the flow of the liquid phase and gas phase of GPL marked with 5g/100 kg of nitromethane and contained in the cylinder of example 1.

The two cotton flocks are then treated with drops of a 0.1% methanol solution of FAST BLUE B SALT.

In both cases a purple colouring develops which is a little weaker when the flock is treated with the gas phase of GPL.

EXAMPLE 6

The test is similar to that of example 5, with the difference that the GPL, used for treating the two cotton flocks soaked in basic solution, is marked with 5g/100 kg of nitroethane.

A reddish-purple colouring develops on the two cotton flocks, subsequently treated with a few drops of reagent, which is a little weaker in the case of the flock treated with the gas phase of GPL.

EXAMPLE 7

10 grams of ethanol hydrate (95.5%), marked with 50 p.p.m. of nitromethane, are mixed with 10 grams of an aqueous solution of $Na_2SO_4$ at 1.5% and $NaHCO_3$ at 1.5% (pH=9.7).

5 grams of an aqueous solution at 0.1% of NQS freshly prepared are then added.

Within a few minutes a stable, purple colouring develops, which reaches its maximum intensity after 15– 20 minutes and with maximum absorption at 574 nm.

EXAMPLE 8

A mixture consisting of 10 parts of an aqueous solution of $Na_2CO_3$ at 4% in water and 5 parts of diglyme, is prepared.

A cotton flock, soaked in this mixture, is treated for 2–3 seconds with the liquid flow of GPL marked with 5g/100 kg of nitromethane and contained in the cylinder of example 1.

The cotton flock is then treated with a few drops of an aqueous solution at 0.1% of NQS.

After a few seconds a blue colouring develops which reaches its maximum intensity after 5–10 minutes.

A similar colouring, but a little weaker, appears after the cotton flock, soaked in the same solution, has been subjected, for 10–15 seconds, to the flow of the gas phase of the same marked GPL, and then treated with the same reagent NQS.

EXAMPLE 9

A mixture is prepared consisting of 10 parts of a solution of $Na_2CO_3$ at 10% in water and 5 parts of ethylene glycol.

A cotton flock, soaked in this mixture, is treated for 2–3 seconds with the liquid flow of GPL marked with 10g/100 kg of nitromethane and contained in a 10 $m^3$ tank, filled for 90% of its volume with the liquid phase (10° C., 6kg/$cm^2$).

The cotton flock is then treated with several drops of an aqueous solution at 0.1% of NQS.

After a few seconds a violet colouring develops which reaches its maximum intensity after 5–10 minutes..

A similar colouring, but with a lesser intensity, appears after the cotton flock, soaked in the same solution, has been subjected for 10–15 seconds to the flow of the gas phase of the same marked GPL coming from the tank, and then treated with the same reagent NQS.

What is claimed is:

1. A process for marking a material selected from the group consisting of (1) industrial organic solvents miscible with water and (2) petroleum products, gaseous at atmospheric pressure and room temperature and liquid when compressed at low pressure, which comprises adding to the above material marking sufficient amounts of a primary nitroderivative having general formula (I)

$$R\text{-}CH_2\text{-}NO_2 \quad (I)$$

wherein R is selected from H, $CH_3$, and $C_2H_5$.

2. A process according to claim 1, wherein the nitroderivative of general formula (I) is selected from nitromethane and nitroethane.

3. A process according to claim 1, wherein the nitroderivative of general formula (I) is present in a quantity of between 10 and 200 p.p.m.

4. A process according to claim 3, wherein the nitroderivative of general formula (I) is present in a quantity of between 20 and 100 p.p.m.

5. A process according to claim 1, wherein the material is liquefied petroleum gas.

6. A process for identifying petroleum products marked with primary nitroderivatives of general formula (I)

$$R\text{-}CH_2\text{-}NO_2 \quad (I)$$

wherein R is selected from H, $CH_3$, and $C_2H_5$, which consists in extracting the above nitroderivative in a basic medium and observing the colour developed from the reaction of the nitroderivative with a diazo-compound of an aromatic amine.

7. A process according to claim 6, wherein the diazocompound of the aromatic amine is the salt of tetrazonium of o-dianisidine.

8. A process for identifying industrial organic solvents miscible with water and petroleum products, gaseous at atmospheric pressure and room temperature and liquid when compressed at low pressure, marked with nitromethane, which consists in extracting with water or mixtures of polar organic solvents and water, at a pH of between 9 and 12, and observing the chromatic tonality which develops from the reaction of the nitromethane with 1,2-naphthoquinone-4-sodium sulphonate (NQS).

9. A composition consisting essentially of an industrial organic solvent miscible with water and marking sufficient amounts of a primary nitroderivative of general formula (I)

$$R\text{-}CH_2\text{-}NO_2 \quad (I)$$

wherein R is selected from H, $CH_3$, and $C_2H_5$.

10. A composition consisting essentially of a petroleum product gaseous at atmospheric pressure and room temperature and liquid when compressed at low pressure, and marking sufficient amounts of a primary nitroderivative of general formula (I)

$$R\text{-}CH_2\text{-}NO_2 \quad (I)$$

wherein R is selected from H, $CH_3$, and $C_2H_5$.

11. A composition consisting essentially of liquefied petroleum gas and marking sufficient amounts of a primary nitroderivative of general formula (I)

$$R\text{-}CH_2\text{-}NO_2 \quad (I)$$

wherein R is selected from H, $CH_3$, and $C_2H_5$.

* * * * *